US007064667B2

(12) United States Patent
Sosna

(10) Patent No.: US 7,064,667 B2
(45) Date of Patent: Jun. 20, 2006

(54) SECURITY ALARM SYSTEM FOR PERSONAL BAGGAGE

(75) Inventor: Linda Sosna, St. Louis, MO (US)

(73) Assignee: Security Advantage, L.L.C., Creve Coeur, MO (US)

( * ) Notice: Subject to any disclaimer, the term of this patent is extended or adjusted under 35 U.S.C. 154(b) by 31 days.

(21) Appl. No.: 10/605,594

(22) Filed: Oct. 10, 2003

(65) Prior Publication Data

US 2004/0104820 A1 Jun. 3, 2004

Related U.S. Application Data

(60) Provisional application No. 60/319,608, filed on Oct. 11, 2002.

(51) Int. Cl.
*G08B 13/14* (2006.01)

(52) U.S. Cl. ..... 340/568.7; 340/568.1; 340/541; 340/546; 340/545.6; 340/571

(58) Field of Classification Search ..... 340/568.7, 340/568.6, 568.1, 571, 574, 545.6, 539.1, 340/539.19, 539.31, 541, 573.4, 546, 539.11
See application file for complete search history.

(56) References Cited

U.S. PATENT DOCUMENTS 3,851,326 A 11/1974 Costa
3,893,096 A 7/1975 Tucci et al.
3,938,126 A 2/1976 Ransom
4,755,802 A 7/1988 Urbanczyk
5,153,561 A 10/1992 Johnson
5,661,456 A 8/1997 Staehle, Jr.
5,835,013 A 11/1998 Duterte
5,920,260 A 7/1999 Tseng
5,949,333 A * 9/1999 Lehmann et al. ..... 340/571
5,955,948 A 9/1999 Howell
5,963,131 A * 10/1999 D'Angelo et al. ..... 340/568.1
6,121,877 A 9/2000 Johnson et al.
6,133,831 A 10/2000 Kyles
6,140,923 A 10/2000 Lam
6,166,635 A * 12/2000 Huang ..... 340/571
6,181,246 B1 1/2001 Ewing et al.
6,340,235 B1 1/2002 Bryan
6,380,856 B1 4/2002 Johnson et al.

* cited by examiner

*Primary Examiner*—Hung Nguyen
(74) *Attorney, Agent, or Firm*—Blackwell Sanders Peper Martin LLP

(57) ABSTRACT

A portable security alarm device for use with personal baggage wherein the personal baggage includes an opening and closing mechanism, the security alarm device including a trigger mechanism for determining when the personal baggage is in at least a partially opened position, an alarm mechanism for emitting an audible alarm when activated, an operator input device operable for selectively activating various states of operation of the device including an activated state, an off state, and a programming stat wherein a user can reprogram the access code inputted into the operator input device to activate certain states of operation. The present device likewise includes a Panic button for immediately activating the alarm mechanism and a removably attachable/detachable mechanism which enables the present device to be portable for attaching and detaching to a plurality of different personal baggage.

39 Claims, 5 Drawing Sheets

SECURITY ALARM SYSTEM FOR PERSONAL BAGGAGE

CROSS REFERENCE TO RELATED APPLICATIONS

This application claims the benefit of U.S. Provisional application Ser. No. 60/319,608 filed Oct. 11, 2002.

BACKGROUND OF INVENTION

The present invention relates generally to the field of personal baggage alarms and, more specifically, to a security system designed to prevent the theft of items contained in a piece of personal baggage such as a purse.

Personal baggage is widely used for carrying a wide variety of items such as clothing, toys, portable electronic devices, personal hygiene effects, tools, credit cards, papers and the like. Personal baggage varies in type, size and shape, and for the purposes of the present application the term "personal baggage" is meant to encompass items such as purses, handbags, backpacks, brief cases, various attaché cases, laptop computer cases, camera cases, garment bags, sports bags, tote bags and any other device commonly used by a person to manually transport items from one location to another.

Common to all personal baggage are means for closing the baggage so items contained therein are not lost or stolen. Common closure means include zippers, buttons, magnetic closure means, snap fasteners, VELCRO® closure means, and a wide variety of other cooperatively engageable means. Still other closure means are also known to exist. Each closure means provides a measure of security to the personal baggage. Unfortunately, none of the commonly used closure means, in and of themselves, are sufficient to prevent pick-pocketing or other forms of theft. There is, therefore, a need for a security system usable with a wide variety of different personal baggage for the purpose of preventing and deterring theft of the baggage and their contents.

In addition, the presence of personal baggage may attract the attention of would-be thieves and the like because it is well known that people often carry items of value within their personal baggage. For example, carrying a purse may make one a target for theft because it is well known that individuals carry money, credit cards, cellular phones, personal identity information, and other valuables therewithin. On occasion, the carrier of a purse or other personal baggage may perceive a threat of theft or attack before it occurs but may be powerless to either escape from the situation or in some way deter the thief. There is, therefore, also a need for a theft deterrence system associated with a personal baggage such that the deterrence system is always visible and accessible when the personal baggage is in use. In this regard, there is even a greater need for a deterrence system which is portable and can be disconnected and reinstalled on different personal baggage so that one device can be used with a wide variety of different personal baggage owned by a single individual.

Still further, it is known that personal baggage, such as purses, are often chosen for aesthetic reasons as well as for their functional qualities. Purses, particularly, are considered to be fashion accessories as well as items for use in the carrying of one's personal effects. There is, therefore, a further need to provide a security alarm system for purses and other personal baggage that is aesthetically pleasing when associated with the personal baggage and that is adaptable for use with various styles and colors of personal baggage.

Attempts have been made in the past to address the concerns noted above, however the devices currently available fall short of the goal of the present invention, namely, providing a portable secure theft prevention and deterrence system for use with a wide variety of personal baggage.

Accordingly, the present invention is directed to overcoming one or more of the problems associated with the known prior art devices.

SUMMARY OF INVENTION

In one embodiment of the present invention, the present device will detect the opening of a purse or other personal baggage based upon the movement of a zipper closure mechanism from the closed position to a partially open position. A circuit senses that the zipper has moved beyond a predetermined position by way of an alarm pin that is pulled away from the present device during the opening of the zipper, thereby breaking continuity with a circuit to produce an audible alarm.

The present device includes a housing structure having a ring or clasp associated therewith which is removably attachable to the zipper clasp associated with the purse or other personal baggage. In similar fashion, one end portion of the alarm pin is attached to the body portion of the purse or other personal baggage via a multitude of different types of attachment mechanisms in the area where the zipper is typically in this closed position. As a result, as the zipper is moved from its closed position to an open position, the present device travels with the zipper clasp and as the attachment means associated with the alarm pin reaches full extension, the alarm pin is pulled free from the present device thereby activating the audible alarm. This overall attachment arrangement enables the present device to be portable so that it can be moved from one personal baggage to another personal baggage such as from one purse to another purse, to a briefcase, a laptop computer case, and so forth.

The present device further includes a programmable keypad for use as a user-interface or operator input device to activate and deactivate the alarm, and to enter and exit other operating states including a programming state whereby a user can change the security code, password or other access code for activating and deactivating the present alarm system. A light-emitting diode (LED) is provided to indicate that the alarm is functioning properly and also to signal whether the alarm is in the activated, deactivated, alarm or programming state.

The present device also further includes a panic button that can be depressed to directly activate an audible alarm. The panic button is provided so that the user can activate the alarm when confronted with a potentially dangerous situation such as an attack or theft.

In still other embodiments, the present device may be provided with a plurality of detachable housing covers or face plates such that one cover or face plate member may be removed and replaced with another cover or face plate member having a different color or different fashionable design associated therewith so as to be fashion coordinated on particular occasions.

Alternate embodiments of the present invention are provided such that the present device can be used with a variety of different personal baggage such as backpacks, laptop carriers, camera cases and the like.

DETAILED DESCRIPTION

Figure 1:
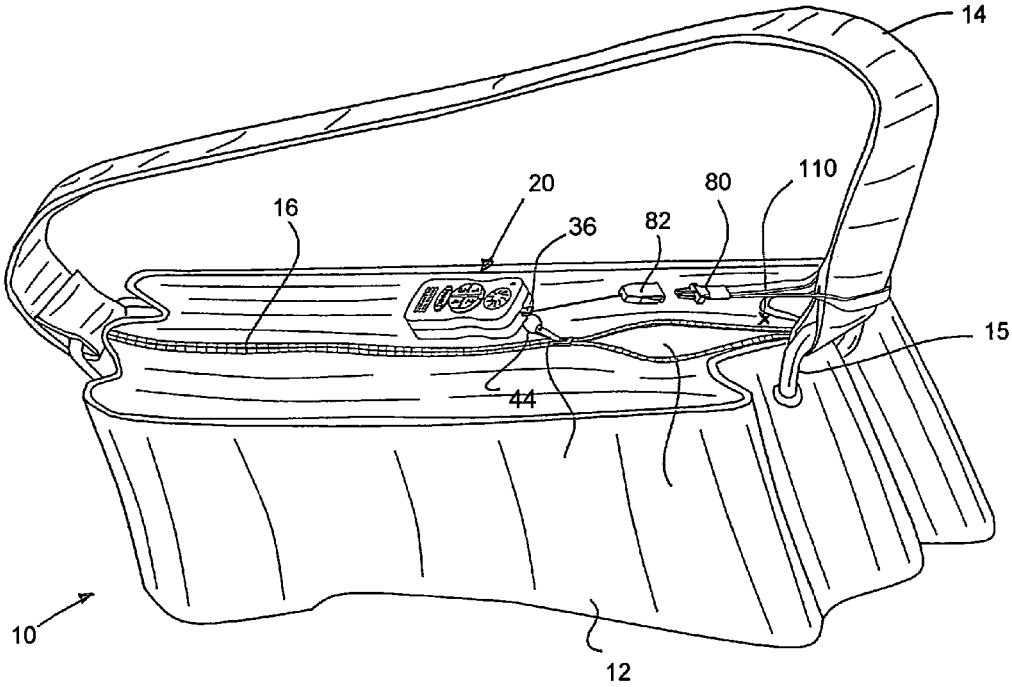
FIG. 1 is a perspective view illustrating the placement of one embodiment of the present security alarm system unto one type of personal baggage, namely, a purse.

Referring now to the drawings wherein like numerals refer to like parts, numeral 10 in FIG. 1 refers generally to one type of personal baggage, namely, a purse, having one embodiment of the present security device 20 attached thereto. Although the present security alarm device will be operationally described in conjunction with a typical purse 10, it is understood that the present device is not limited to use only with purses, but that it is equally adapted for use with a wide variety of different personal baggage as will be hereinafter further explained. As a result, the purse embodiment depicted herein is intended to be merely illustrative and not restrictive in any sense.

The purse 10 illustrated in FIG. 1 is typical of many purses found in the prior art and includes a body portion 12 wherein personal items such as cosmetics, money, credit cards and other portable items are contained. A strap member 14 or other means of carrying the purse 10 portions, such as a handle (not shown) for other types of personal baggage, is attached to body portion 12 in a conventional manner. Purse body 12 further includes zipper closure means 16 extending along the length of an openable and closeable portion 17, the zipper 16 having a conventional clasp 18 for use in moving the zipper 16 between its opened and closed positions. The present device 20 is attached to the zipper clasp 18 by means of ring member 44, although any suitable attachment means such as a short cord or wire member may be used, and, in this particular arrangement, alarm pin 36 is attached to strap member 14 via attachment mechanism 42 as will be hereinafter explained. Alarm pin 36 functions as a trigger mechanism or detector means for activating an alarm mechanism as will be also hereinafter explained.

Figure 2:
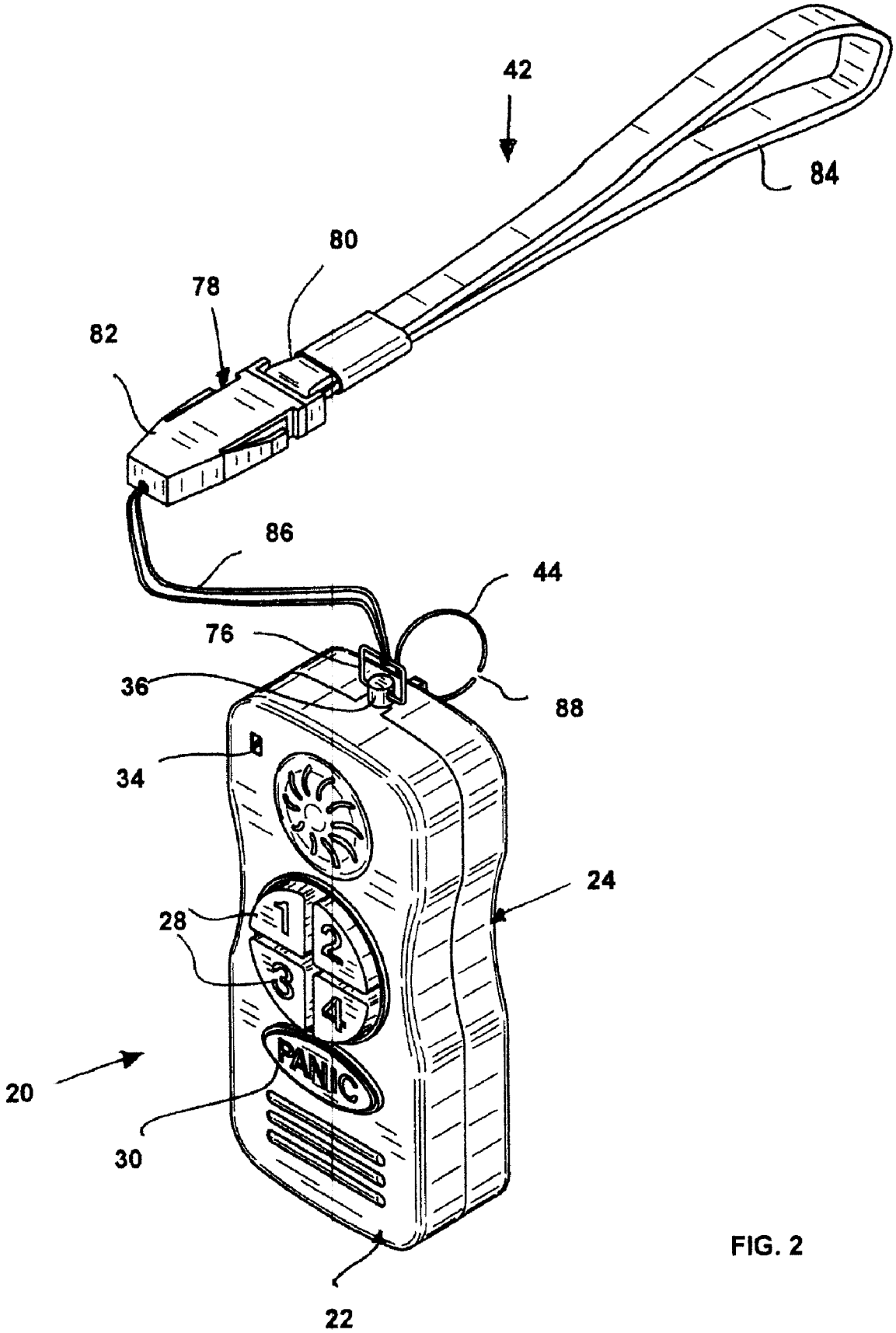
FIG. 2 is a perspective view of one embodiment of the present security alarm system.
Figure 3:
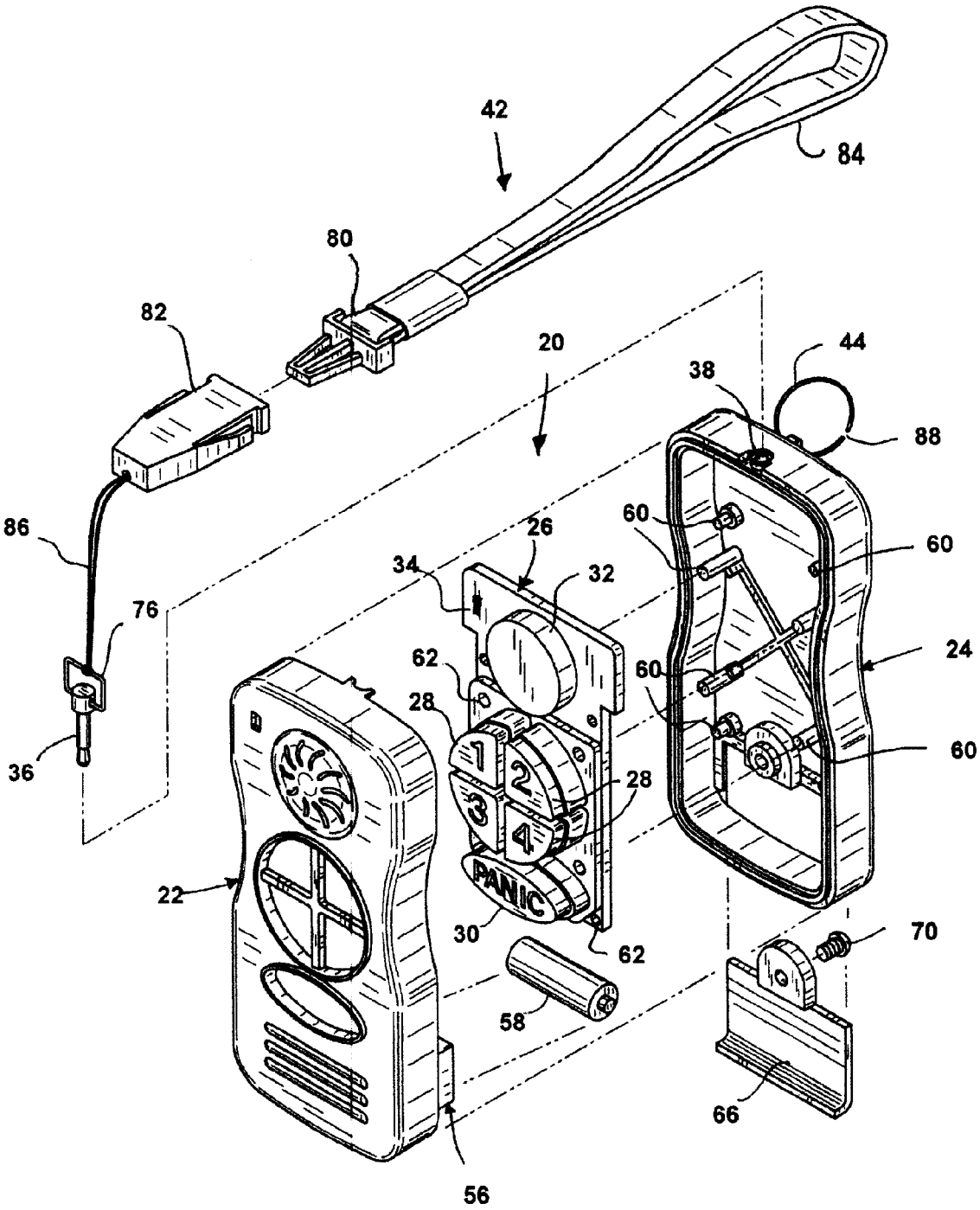
FIG. 3 is an exploded perspective view of one embodiment of the present security alarm system.

As best illustrated in FIGS. 2 and 3, the present security device 20 includes a front housing portion 22, a rear housing portion 24, a printed circuit board (PCB) 26, alarm pin 36, an opening 38 adapted for receiving alarm pin 36, attachment mechanism 42 attached to alarm pin 36, and ring member 44 associated with the rear housing portion 24. The printed circuit board 26 includes programmable keypad push buttons 28, a panic button 30, audible alarm apparatus 32, light emitting diode (LED) 34, and appropriate circuitry for accomplishing the various states of operation associated with the present device 20. The PCB module 26 is housed between the front and rear housing portions 22 and 24 as best illustrated in FIG. 3 and as will be hereinafter further explained.

Figure 4A:
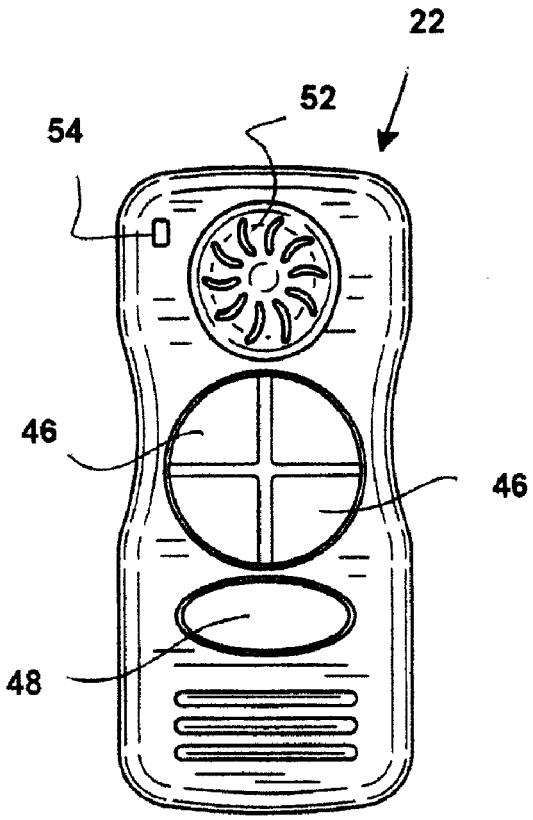
FIGS. 4A, 4B and 4C are front, rear and side elevational views of one embodiment of a front housing member associated with the present security alarm system.
Figure 4B:
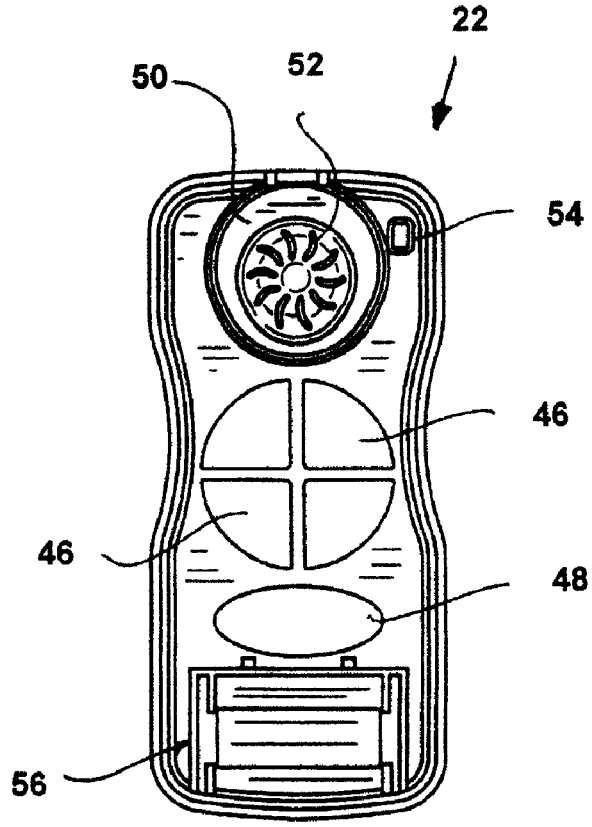
Figure 4C:
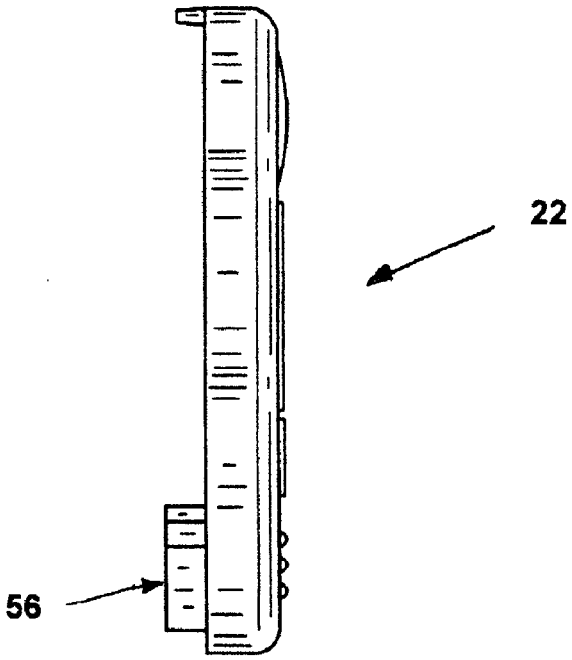

FIGS. 4A, 4B and 4C illustrate one embodiment of the front housing member 22, FIG. 4A representing a front elevational view of the housing member 22, FIG. 4B representing a rear elevational view of member 22 showing the housing cavity associated therewith, and FIG. 4C representing a side elevational view of member 22. Housing member 22 includes a plurality of openings 46 positioned and located so as to cooperatively receive the keypad push buttons 28 associated with PCB module 26, and an opening 48 adapted to receive panic button 30 likewise associated with PCB module 26. It is recognized and anticipated that the openings 46 and 48 will be positioned and located so as to cooperatively receive the corresponding push buttons 28 and 30. Although the present device 20 is illustrated herein as having four push buttons 28 associated with PCB module 26, it is recognized and anticipated that any plurality of push buttons 28 and corresponding openings 46 may be associated with any particular embodiment of the present device 20. As best illustrated in FIG. 4B, housing member 22 likewise includes cavity portion 50 having grill portion 52 associated therewith for receiving audible alarm 32 associated with PCB module 26 as well as opening 54 positioned and located for receiving LED 34. Still further, housing member 22 also includes battery compartment 56 adapted to hold at least one battery such as battery 58 illustrated in FIG. 3 for powering the device 20.

Figure 5A:
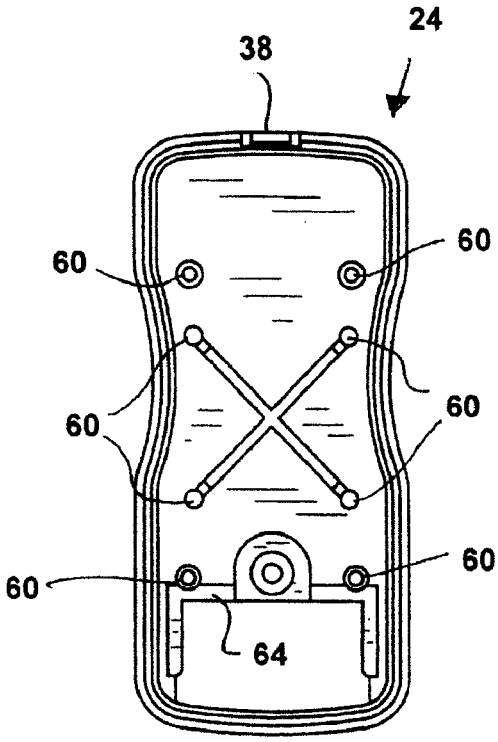
FIGS. 5A, 5B and 5C are front, rear and side elevational views of one embodiment of a rear housing member associated with the present security alarm system.
Figure 5B:
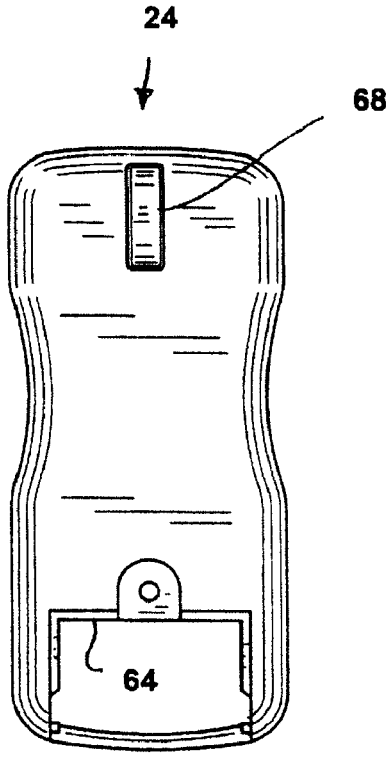
Figure 5C:
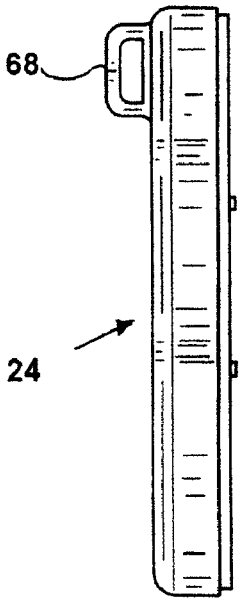

FIGS. 5A, 5B and 5C illustrate one embodiment of rear housing member 24, FIG. 5A representing a front elevational view of housing member 24 illustrating the housing cavity associated therewith, FIG. 5B representing a rear elevational view of member 24, and FIG. 5C representing a side elevational view thereof. As best illustrated in FIG. 3, rear housing member 24 includes a plurality of pin members 60 for cooperatively receiving corresponding openings 62 located in PCB module 26 for both aligning the PCB module and associated keypad within rear housing member 24 and for likewise securing the PCB module therewithin. Housing member 24 likewise includes appropriate framing structure 64 for receiving battery door 66 (FIG. 3). Eye loop 68 is formed or otherwise associated with the rear portion of housing member 24 and is adapted to receive ring member 44 as illustrated in FIGS. 2 and 3. Battery door 66 is removably attached via screw member 70 so as to provide easy access to battery 58 for replacement thereof.

Figure 6A:
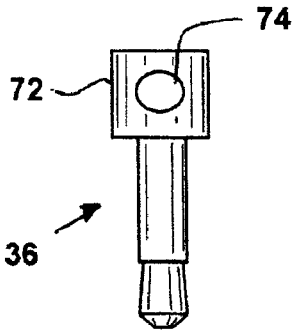
FIGS. 6A and 6B are elevational views of one embodiment of an alarm pin associated with the present security alarm system.
Figure 6B:
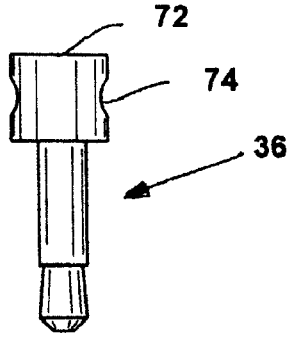

FIGS. 6A and 6B illustrate one embodiment of alarm pin 36 which includes head portion 72 having an opening 74 extending therethrough. As best illustrated in FIG. 3, opening 74 is adaptable to receive member 76 (FIG. 3) which, in turn, is attached to attachment mechanism 42 as best illustrated in FIG. 3. Attachment mechanism 42 includes a conventional clip type member 78 having respective male and female portions 80 and 82, male portion 80 having a band or strap 84 associated therewith as best illustrated in FIGS. 2 and 3 and female portion 82 being attached to member 76 via cord member 86. A two-piece attachment mechanism such as attachment member 42 facilitates attachment to the purse 10 in the area adjacent to where zipper 16 is in its closed position as will be hereinafter further explained.

As best illustrated in FIG. 1, the present security device 20 is operatively attached to a piece of personal baggage such as purse 10 by attaching ring member 44 to zipper clasp 18 and by attaching the male portion 80 of attachment mechanism 42 to purse body 12 adjacent the closed position of zipper 16. More particularly, ring member 44 includes a conventional slit or slot 88 whereby the corresponding end portions of ring member 44 can be separated and spaced so as to be received within the opening commonly associated with zipper clasp 18. This securely fastens the present device 20 to zipper clasp 18 thereby allowing the present device 20 to move the zipper clasp 18 as it traverses the length of the openable and closeable portion 17. On the other hand, attachment member 42, which is attached to alarm pin 36, can be easily attached to purse 10 adjacent the area where zipper 16 is in its closed position by separating male and female portions 80 and 82 and attaching male portion 80, for example, to strap member 14 of purse 10 as illustrated in FIG. 1. This attachment can be accomplished by looping cord member 84 around strap member 14 and passing the male portion 80 of clip member 78 through cord member 84 so as to secure male portion 80 thereto. It is also recognized and anticipated that male portion 80 can be maneuvered and manipulated in other fashions so as to be removably fixedly attached to strap member 14. It is also recognized that male portion 80 can likewise be attached to the purse strap anchor or ring support member 15 adjacent the closed position of zipper 16. Once male portion 80 of attachment mechanism 42 is removably attached to purse 10 in the area adjacent the closed position of zipper 16, male portion 80 can be securely attached to female portion 82 thereby completing a direct attachment to alarm pin 36. FIG. 1 illustrates attachment of male portion 80 to strap member 14 immediately prior to cooperative engagement with female portion 82.

It can therefore be readily seen that when alarm pin 36 is engaged with the present alarm system 20 by inserting pin 36 into opening 38, and when zipper 16 is in its closed position, there will be sufficient slack in attachment mechanism 42 such that pin member 36 will remain engaged with the present device 20. As zipper 16 is moved from its closed position towards its open position as illustrated in FIG. 1, the present device 20 is moved in conjunction with zipper clasp 18. As the present device 20 moves away from its closed position along with zipper clasp 18, and since one end portion of the alarm pin 36 is fixedly secured to the purse body 12 via attachment mechanism 42, as tension develops on attachment mechanism 42, the alarm pin 36 begins to move away from the present device 20 and out of engagement with opening 38. The present device 36 senses the withdrawal of alarm pin 36 from opening 38. In this regard, the circuitry associated with PCB module 26 can be configured so as to sense either the presence or absence of alarm pin 36 within opening 38. For example, the presence of alarm pin 36 within opening 38 may complete a circuit in the present device 20. Alternatively, the presence of alarm pin 36 within opening 38 may interrupt a circuit within the present device 20. In the case where alarm pin 36 completes a circuit within device 20, the present device senses the breaking of such circuit when alarm pin 36 is fully or partially removed thereby activating an audible alarm. In the case where alarm pin 36 interrupts a circuit within device 20, the present device 20 senses the interruption of such circuit when alarm pin 36 is fully or partially removed thereby likewise triggering an audible alarm. In either event, the device 20 moves into the Alarm State when alarm pin 36 is removed from opening 38 as will be hereinafter more fully explained. As such, alarm pin 36 serves as a triggering mechanism or detector mechanism for determining when the opening and closing means of the personal baggage is in at least a partially opened position. It is also recognized and anticipated that although attachment mechanism 42 has been described in association with alarm pin 36, a wide variety of different types of attachment mechanisms for attaching one end portion of alarm pin 36 to the body portion of a personal baggage such as purse 10 in the area adjacent the closed position of zipper 16 can likewise be utilized to accomplish the stated objective.

Figure 7:
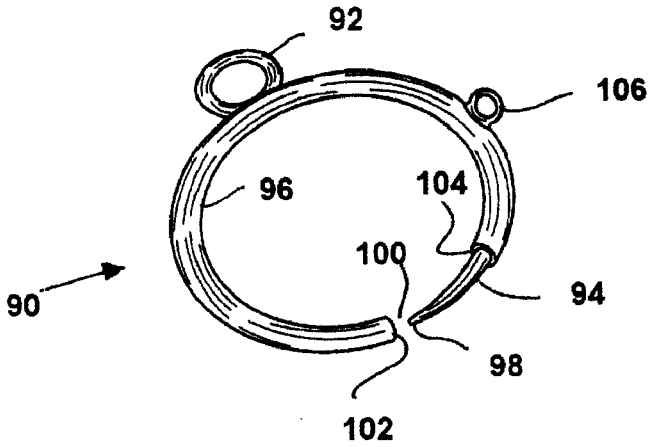
FIG. 7 is a perspective view of another embodiment of the attachment mechanism associated with the alarm pin.

In this regard, FIG. 7 represents another attachment mechanism 90 which can be utilized to operatively attach alarm pin 36 to purse body 12 adjacent the closed position of zipper 16. Attachment mechanism 90 includes an eye loop or ring portion 92 which is directly engageable to member 76 which, in turn, is attached to alarm pin 36 through opening 74. Attachment mechanism 90 likewise includes a piercing member 94 housed within a cylindrical sleeve member 96 as best shown in FIG. 7. The piercing member 94 includes a sharp terminal end portion 98 and is retractable into sleeve member 96 so as to open up the space 100 between the opposed end portions 102 and 104 of sleeve member 96. Movement of piercing member 94 is accomplished through movement of member 106 which is otherwise attached to piercing member 94 and is biased such that member 94 will completely close the space 100 and the terminal end portion 98 thereof will be received and housed within end portion 102 of sleeve member 96. A slot (not shown) located in sleeve member 96 allows member 106 to be moved along the perimeter of sleeve member 96 to retract and extend piercing member 94. Attachment mechanism 90 is designed for attachment directly to the web portion of zipper 16 in the area adjacent to where zipper 16 is in its closed position by retracting piercing member 94 a sufficient distance such that the web portion of one side of zipper 16 can be inserted within the space 100, at which time piercing member 94 is extended and forced through such web material via member 106 so as to engage end portion 102 of sleeve member 96. In the embodiment of purse 10 illustrated in FIG. 1, piercing member 94 would be inserted, for example, through the purse material adjacent zipper 16 in the area designated 110.

It is recognized and anticipated that the attachment mechanism 90 can be punctured through any appropriate portion of the personal baggage in the area adjacent to where the zipper 16 or other appropriate closure mechanism is in its substantially closed position including areas associated with purse body 12 other than the web portion 110 indicated in FIG. 1. Since piercing member 94 is biased to its fully closed position wherein terminal end portion 98 is housed within end portion 102 of sleeve member 96, attachment mechanism 90 will remain engaged with the personal baggage. Movement of member 106 against the biasing means to open up the space 100 between sleeve end protions 102 and 104 will allow piercing member 94 to become disengaged with the personal baggage allowing removal of attachment mechanism 90 therefrom. It is recognized and anticipated that still other types of attachment mechanisms other than the mechanisms 42 and 90 illustrated herein can be utilized to attach alarm pin 36 to the body portion of a personal baggage such as purse 10 to accomplish the stated objective.

In one embodiment of the present invention, the present device 20 is provided with five states of operation: Off, Activated, Programming, Alarm and Panic. For purposes of describing the operation of the present device, we will begin our discussion with the Off State. Upon installation of appropriate batteries such as battery 58, the present device 20 will be in the Off State. In the Off State, device 20 has no functional operation other than to sense the pressing of push buttons 28 (operator input means) by a user for entry of the appropriate security code, access code or password in order to place device 20 in either its Activated or Programming State, or to sense the pressing of the panic button 30 (another operator input means) as will be hereinafter further explained. In the Off State, the LED 34 will not be illuminated and the audible alarm or buzzer 32 will not be activated.

Entering the correct security code, access code or password using operator input means 28 will, for example, cause one embodiment of the present security device 20 to enter the Activated State. A user can program and reprogram the present device 20 as will be hereinafter explained to his/her own personal security code. If the correct security code or access code is not entered within some predetermined time period such as within ten (10) seconds of when the first push button 28 was pressed, the present device 20 will remain in the Off State.

Upon installation of batteries, a default access code or security code will be set, for example, in the embodiment illustrated in FIGS. 2 and 3, this default access code may be 1, 2, 3, 4. The user must enter the default code within the appropriate predetermined time period to enter the Activated State. In the Activated State, the LED 34 will flash at a predetermined rate such as at a rate of illumination of approximately 5 milliseconds every two (2) seconds, and the audible alarm or buzzer 32 will not be activated. Illumination of the LED 34 while in the Activated State allows a user to visually determine that the present device 20 is operational and is in the Activated State. To return to the Off State from the Activated State, the user must again input the correct security code or access code within the predetermined time period. In the Activated State, the present device 20 monitors alarm pin 36 and senses the pressing of push buttons 28 and panic button 30. If alarm pin 36 is removed from opening 38, or if the device senses a loss in continuity between alarm pin 36 and the circuitry associated with PCB module 26, the present device 20 will enter the Alarm State. In the Alarm State, an audible alarm will sound by means of audible alarm unit 32 until the alarm pin 36 is replaced within opening 38, or circuit continuity is restored, or the proper access code or security code is entered within the predetermined time to return the device to the Off State.

As indicated above, the Alarm State can be entered by (1) removing the alarm pin 36 from opening 38, (2) if the present device senses some loss of continuity between the alarm pin 36 and the circuitry associated with PCB module 26, and (3) as will be hereinafter further explained, by pressing the panic button 30 for a predetermined period of time when the present device 20 is either in the Activated State or other Off State. During the Alarm State, the LED 34 will flash at a predetermined rate such as at a rate of illumination of approximately 10 milliseconds every 170 milliseconds and the audible alarm or buzzer 32 will be activated. If the Alarm State is activated by removal of the alarm pin 36 from opening 38, re-insertion of the alarm pin 36 into opening 38 will return the present device 20 to the Activated State. Also, as previously indicated, when the present device 20 is in the Alarm State, the user may alternatively input the correct password or security code within the predetermined time period and, if this should occur, the present device 20 will return to the Off State.

The Programming State is used to change a user's password or security code. This is particularly true when the present device 20 is initially activated since the present system will automatically enter a default code upon installation of battery 58. In order to personalize and selectively change the security code or access code for entering the various states of operation of the present device 20, a user will enter the Programming State. In this regard, while in the Off State, a user can enter the programming state by inputting an access code such as by pushing a specific series or combination of push buttons 28, or by pushing one or more push buttons 28 for a predetermined minimum period of time. For example, in the embodiment illustrated in FIGS. 2 and 3, the Programming State can be entered by a user pressing, for example, two of the push buttons 28 (for example, push buttons 1 and 2) simultaneously for a minimum of five (5) seconds. Once the correct push button combination as well as any predetermined time period is satisfied, the present device 20 will enter the Programming State. Upon entering the Programming State, the audible alarm 32 may optionally beep or otherwise sound so as to give the user an audible indication that the Programming State has been activated and the device 20 is ready to accept a new access code. In addition, while in the Programming State, the LED 34 will again flash at a predetermined rate such as at a rate of illumination of approximately ten (10) milliseconds every one hundred seventy (170) milliseconds so as to give the user a visual indication that the Programming State has been activated. Also, while in the Programming State, the buzzer or audible alarm 32 will not be activated.

Once the present device 20 is in the Programming State, a user can reprogram the security code or password. In this regard, a user must then input the new four (4) digit password, or any other appropriate number of digits, within a predetermined time period. The next four push buttons 28 pressed within the predetermined time period will establish the new code or password and such code will be recorded in device 20 as the new code sequence for subsequent use. In a preferred embodiment, for example, the predetermined time period for entering a new security code is ten (10) seconds. In alternative embodiments, any suitable time period may be used. In this way, the user can change the security code as often as desired or necessary to whatever security code the user desires. Once the new security code has been entered and accepted, the present device 20 immediately returns to the Off State. If more or fewer than four digits, for example, are recorded within the predetermined time period, the audible alarm 32 will sound for a predetermined time period or a predetermined number of times, the present device 20 will not record and enter the new security code or password, and the device 20 will return to the Off State and will disregard the sequence of push buttons 28 that was entered in the failed attempt to change the security code. In this event, the previous security code or password will remain in effect. After a predetermined time period expires, device 20 will return to the Off State even though no new code was entered. Although the security code is illustrated and discussed as being a four-digit code in the embodiment of the present device illustrated in FIGS. 2 and 3, the length or number of digits associated with the security code may be varied, for example, a six-digit code may be used, without departing from the spirit and scope of the present invention.

As previously indicated, if the present device 20 is in either the Alarm State or the Activated State, the correct security code must be entered in order to return the device to the Off State. Again, the correct security code must be entered within a predetermined time period, otherwise the sequence being entered will become invalid and expire and the device will remain in its previous state, either the Alarm State or the Activated State. It is also important to note that all of the preceding illumination rates are illustrative only, serving only to illustrate the operation of LED 34 in one embodiment of the present invention. Naturally, the precise pattern of LED illumination, including duration of illumination and length of time between illuminations, may be varied without departing from the scope of the present invention.

Likewise, the specific operation of audible alarm 32 may be varied without departing from the scope of the present invention. In one embodiment of the present invention, the audible alarm 32 may be activated for approximately 50 milliseconds every time one of the push buttons 28 is pressed. In other embodiments, the time for which audible alarm 32 is activated during the pressing of one push button 28 may vary, or audible alarm 32 may not be activated at all during the pressing of a push button. Also, in a preferred embodiment, audible alarm 32 is activated continuously while device 20 is in the Alarm State. Again, the precise activation of audible alarm 32 during various states of operation may vary from embodiment to embodiment. When audible alarm 32 is activated, it may produce a buzzer sound, an audible tone, or any other sound suitable for the purposes of the present device. For example, it may produce a verbal response such as the words "stop thief" or some other verbal message suitable for drawing attention or discouraging a thief instead of producing a buzzer sound or tone. It is contemplated that audible alarm 32 may be designed to produce a variety of responses without departing from the spirit and scope of the present invention.

In order for the present device 20 to enter the Panic State, operator input means in the form of Panic button 30 must be pressed. The Panic State is accessible only from the Activated State or the Off State. In one embodiment of the present invention, Panic button 30 must be held down for a predetermined period of time such as for a minimum of three (3) seconds in order for device 20 to enter the Panic State. This prevents inadvertent entry into the Panic State if Panic button 30 is brushed or pushed inadvertently. The precise time period for which Panic button 30 must be pressed in order to enter the Panic State may be varied without departing from the spirit or scope of the present invention. Once the Panic button 30 is held depressed for the predetermined time period, the present device 20 will automatically enter the Alarm State and the audible alarm 32 will sound continuously. Various methods may be employed for exiting the Panic State. For example, in one embodiment of the present invention, a user may press Panic button 30 for a predetermined period of time such as for a minimum of 300 milliseconds in order to exit the Panic State, or a user may press the Panic button 30 two sequential times to exit the Panic State, or the user may input the correct security code or password within the predetermined time period to exit the Panic State and return to the Off State. The amount of time, or number of times, for which Panic button 30 must be pressed may vary from embodiment to embodiment. When device 20 exits the Panic State, it returns to the previous state from which it was accessed, namely, the Activated State or the Off State. The precise method of exiting the Panic State, including how the Panic button 30 must be pressed, may be varied without departing from the spirit and scope of the present invention.

Another aspect of the present invention resides in the use of a detachable cover or front housing member such as member 22 illustrated in FIG. 3. In this regard, it is anticipated that any plurality of detachable front housing covers such as members 22 having all of the corresponding openings such as openings 46 and 48 to register with push buttons 28 and 30 can be provided in assorted colors and patterns for aesthetic and fashionable reasons. In one embodiment, the front housing member 22 may be provided in a multitude of different colors and patterns and member 22 may be removably attachably secured to rear housing member 24 through use of a wide variety of well known means in the art such as cooperative engageable snap fasteners or clip type means which are positioned and located so as to allow easy access by a user. This allows a user to selectively replace the front housing member 22 based upon the aesthetics associated with the particular personal baggage to which the present device 20 will be attached such as the purse 10 illustrated in FIG. 1.

Instead of providing replaceable front housing members 22, it is also recognized and anticipated that face plate members (not shown) similar to the face plate members utilized with a wide variety of telephone modules can also be provided in a multitude of different colors and patterns, these face plate members likewise having all of the appropriate openings and other features associated with front housing member 22 so that when a removable face plate member is attached in overlaying relationship on top of front housing member 22, all of the various push buttons and other components associated with the present device 20 will still be accessible to the user. In this particular embodiment, the face plate members may include an overlapping peripheral side edge portion which will cooperatively engage the peripheral side edge portion of front housing member 22, either through the use of frictional engagement or through the use of well known cooperatively engageable means such as tabs or projections associated with the face plate member which would be insertably receivable into corresponding slots associated with the side edge portion of front housing member 22. Still other known means for attaching a conventional face plate member in overlaying relationship to the front housing member 22 are known and can be utilized to accomplish this task.

As stated above, detachable front housing members 22 or detachable face plate members can be provided in a variety of colors and fashionable patterns. These detachable members can be changed by the user at will such that the present device 20 can be color coordinated with various items of personal baggage. For example, the present device 20 may have a black front housing member 22 or black removably attachable face plate member when used with a black purse, but when the present device 20 is transferred to a brown purse, the user can remove the black front housing member 22 or black face plate member and replace the same with a brown front housing member 22 or brown overlaying face plate member. Similarly, the user can replace front housing member 22 or other face plate members with a multitude of different such members having fashionable prints or themes associated therewith, such as a red, white, and blue patriotic theme printed thereon. This increases the visibility of the present device 20 and provides a pleasant aesthetically pleasing effect for the user of the present alarm system.

It is also recognized and anticipated that the overall shape and design of the present device 20 may take on a wide variety of different configurations. For example, the front and rear housing members 22 and 24 may take on different shapes and may include different feature orientations. For example, the push buttons 28 and 30 as well as audible alarm 32 and LED 34 may be positioned and located in different locations and may take on different configurations and styles as compared to the size, shape and arrangement of such members on the present device 20 illustrated in FIGS. 2 and 3. In this regard, different housing configurations and styles are disclosed in U.S. patent application Ser. No. 60/319,608, which application is incorporated herein by reference.

Again, the various embodiments described herein are not meant to be limiting. Clearly, one having knowledge of the present disclosure could provide the present device in various sizes, shapes and layouts and still remain within the spirit and scope of the present invention. For example, push buttons 28 may vary in number, size, shape and location. Instead of four push buttons, six may be provided, or eight, or any other number suitable for the purposes of device 20. Similarly, the size, shape, number and location of Panic button 30 may be varied, as well as the size, shape, number and location of LED 34. Various designs may also be used for audible alarm 32, including locating the audible alarm 32 at various locations on the device, using multiple alarms and speakers, and using various patterns of speaker openings. For each of the components of the present device listed above, color and materials may be varied in any way that still allows the present device 20 to be usable for its underlying purpose.

It is also recognized and anticipated that much of the precise operation of the various states of operation described above may be varied without departing from the spirit and scope of the present invention. For example, the number and placement of buttons and lights may be altered. The number of states of operation available to device 20 may be altered. The method of entering and exiting the various states provided by the present device may be altered. Further, as has been mentioned above, the present device 20 is not limited to purses. Instead, the device 20 may be adapted for use with any item of person baggage. Also, although the embodiment described above is adapted for use with personal baggage having a zipper-style closing, the present device may be adapted for use with personal baggage having button closure means, magnetic closure means, or any other means of closure which can be detected by a suitably adapted device. In the case of button closure means, or snap fasteners, for instance, optical sensors or other types of proximity detectors may be used instead of an alarm pin to determine when the item of personal baggage has been opened. Means of detecting the opening of an item are known in the art and it is contemplated that the present device could be adapted to be used with any of these existing means.

As is evident from the foregoing description, certain aspects of the present invention are not limited by the particular details of the examples illustrated herein, and it is therefore contemplated that other changes, modifications, variations and other uses and applications of the present invention, or equivalents thereof, will occur to those skilled in the art. It is accordingly intended that the claims shall cover all such changes, modifications, variations and other uses and applications that do not depart from the spirit and scope of the present invention.

Other aspects, objects and advantages of the present invention can be obtained from a study of the drawings, the disclosure and the appended claims.

What is claimed is:

1. A portable security alarm device for use with a purse having a zipper closure means with a zipper clasp, the security alarm device comprising:

a trigger mechanism for determining when the zipper closure means is in at least a partially opened position;

an alarm mechanism for emitting an audible alarm when activated;

an operator input device for selectively activating a first state of operation wherein said trigger mechanism is activated for determining when the zipper closure means is in at least a partially opened position, a second state of operation wherein certain features of said device can be reprogrammed, and a third state of operation wherein said trigger mechanism is deactivated and said device is in an off state;

a panic button operable for selectively activating said alarm mechanism;

light means operable for indicating various states of operation of said device;

circuit means in electronic communication with said trigger mechanism, said alarm mechanism, said operator input device, said panic button, and said light means;

said circuit means being operable to activate said first state of operation upon inputting an access code into said operator input device;

said circuit means being operable to activate said alarm mechanism when said trigger mechanism determines that the zipper closure means is in at least a partially opened position and when said device is in its first state of operation;

said circuit means being operable to activate said alarm mechanism when said panic button is activated;

said circuit means being operable to activate said second state of operation upon inputting an access code into said operator input device;

said circuit means being operable to activate said third state of operation upon inputting an access code into said operator input device;

said circuit means being operable to deactivate the alarm mechanism upon input of an access code into said operator input device;

a housing structure for housing at least a portion of said trigger mechanism, said alarm mechanism, said operator input device, said panic button, and said circuit means;

attachment means associated with said housing structure for removably attaching said device to the zipper clasp;

attachment means associated with said trigger mechanism for removably attaching said trigger mechanism to the purse in the vicinity adjacent to where the zipper closure means is in its closed position.

2. The portable security alarm device defined in claim 1 wherein activation of said second state of operation enables a user to randomly change the access code for selectively activating the first and third states of operation.

3. The portable security alarm device defined in claim 2 wherein said device will automatically return to said third state of operation upon expiration of a predetermined period of time if no new access code is entered.

4. The portable security alarm device defined in claim 2 wherein said device will automatically return to said third state of operation if an improper access code is entered.

5. The portable security alarm device defined in claim 2 wherein the present device will automatically return to the third state of operation when a new access code is properly entered.

6. The portable security alarm device defined in claim 1 wherein activation of said second state of operation enables a user to randomly change the access code for deactivating the alarm mechanism.

7. The portable security alarm device defined in claim 1 wherein once said alarm mechanism has been selectively activated by said Panic button, said circuit means is further operable to deactivate said alarm mechanism upon further activation of said Panic button.

8. The portable security alarm device defined in claim 7 wherein said further activation of said Panic button includes depressing said Panic button for a predetermined minimum period of time.

9. The portable security alarm device defined in claim 7 wherein said further activation of said Panic button includes depressing said Panic button a predetermined number of sequential times.

10. The portable security alarm device defined in claim 1 wherein said trigger mechanism includes a pin member removably connected to said device, said pin member being pulled out of engagement with said device when the zipper clasp is moved to an at least partially opened position.

11. The portable security alarm device defined in claim 10 wherein said circuit means is further operable to deactivate said alarm mechanism upon reengagement of said pin member with said device.

12. The portable security alarm device defined in claim 1 wherein said attachment means associated with said housing structure includes a ring member.

13. The portable security alarm device defined in claim 1 wherein said attachment means associated with said trigger mechanism includes cooperatively engageable male and female portions, said female portion being attached to said trigger mechanism and said male portion being removably attached to the purse in the vicinity adjacent to where the zipper closure means is in its closed position.

14. The portable security alarm device defined in claim 1 wherein said attachment means associated with said trigger mechanism includes a piercing member engageable with the purse in the vicinity adjacent to where the zipper closure means is in its closed position.

15. The portable security alarm device defined in claim 1 wherein said housing structure includes front and rear portions, said front portion being removably attachable to and detachable from said rear portion.

16. The portable security alarm device defined in claim 1 wherein said housing structure includes front and rear portions, and further including a plurality of face plate members, each face plate member being removably cooperatively engageable with the front portion of said housing structure for changing the aesthetic appearance of said device.

17. The portable security alarm device defined in claim 1 wherein said light means includes a light emitting diode.

18. A portable security alarm device for use with personal baggage wherein the personal baggage includes opening and closing means, the security alarm device comprising:

detector means for determining when the personal baggage is in at least a partially opened position;

alarm means for emitting an audible alarm when the personal baggage is in at least a partially opened position;

operator input means operable for selectively activating at least a first state of operation wherein said detector means is activated for determining when the personal baggage is in at least a partially opened position and a second state of operation wherein said detector means is deactivated, selective activation of said first and second states of operation being accomplished by inputting a security code via said operator input means, said operator input means being further operable to selectively activate a programming state of operation wherein a user can randomly change the security code for activating and deactivating said first and second states of operation;

circuit means in electronic communication with said detector means, said alarm means and said operator input means;

said circuit means being operable to activate said alarm means when said detector means determines that the personal baggage is in at least a partially opened position and when said first state of operation has been selected via said operator input means;

attachment means for removably operatively attaching said device to a personal baggage.

19. The portable security alarm device defined in claim 18 wherein said further operator input means includes a panic button.

20. The portable security alarm device defined in claim 18 wherein said operator input means includes a plurality of push buttons, and wherein activating and deactivating the first and second states of operation is accomplished by inputting a security code via said plurality of push buttons.

21. The portable security alarm device defined in claim 18 wherein selective activation of said programming state of operation is accomplished by inputting an access code via said operator input means.

22. The portable security alarm device defined in claim 18 including light means in electronic communication with said circuit means, said light means illuminating at a predetermined rate of illumination when said device is in its first state of operation.

23. The portable security alarm device defined in claim 18 wherein said detector means includes a pin member removably connected to said security alarm device, said pin member being pulled out of engagement with said device when the personal baggage is in at least a partially opened position.

24. The portable security alarm device defined in claim 23 wherein said attachment means includes means for attaching said security alarm device to the opening and closing means of the personal baggage, and means for attaching said pin member to the personal baggage in the area where the opening and closing means is in its closed position.

25. A portable security alarm device for use with personal baggage wherein the personal baggage includes opening and closing means, the security alarm device comprising:

a trigger mechanism for determining when the personal baggage is in at least a partially opened position;

an alarm mechanism for sounding an audible alarm when activated;

first operator input means operable for selectively activating a first state of operation wherein said trigger mechanism is activated for determining when the personal baggage is in at least a partially opened position and a second state of operation wherein said trigger mechanism is deactivated, said first operator input means enabling selective activation of said first and second states of operation via entry of a security code, said first operator input means being further operable for selective activation of a programming state of operation wherein a user can randomly change the security code for selectively activating the first and second states of operation of said device;

second operator input means operable for selectively activating said alarm mechanism when said device is in either its first or second states of operation;

circuit means in electronic communication with said trigger mechanism, said alarm mechanism, and said first and second operation in put means;

said circuit means being operable to activate said alarm mechanism when said trigger mechanism determines that the personal baggage is in at least a partially opened position and when said first state of operation has been selected;

said circuit means being further operable to activate said alarm mechanism when said second operation input means has been selectively activated;

attachment means for removably operatively attaching said device to a plurality of different personal baggage.

26. The portable security alarm device defined in claim 25 wherein said first operator input means includes a keypad and wherein activating and deactivating the first and second states of operation is accomplished by inputting a security code via said keypad.

27. The portable security alarm device defined in claim 26 wherein the security code must be inputted within a predetermined period of time in order to change the state of operation of said device.

28. The portable security alarm device defined in claim 26 wherein a security code can be entered via said first operator input means within a predetermined period of time in order to deactivate said alarm mechanism when said alarm mechanism is activated via said second operator input means.

29. The portable security alarm device defined in claim 25 wherein said second operator input means includes a panic button.

30. The portable security alarm device defined in claim 29 wherein said panic button must be depressed for a predetermined minimum period of time before said alarm mechanism will be activated.

31. The portable security alarm device defined in claim 30 wherein said panic button must be depressed for a predetermined minimum period of time in order to deactivate said alarm mechanism.

32. The portable security alarm device defined in claim 30 wherein said panic button must be depressed a predetermined number of sequential times in order to deactivate said alarm mechanism.

33. The portable security alarm device defined in claim 25 wherein said first operator input means includes a keypad and wherein activation of said programming state of operation is accomplished by entering an access code via said keypad.

34. The portable security alarm device defined in claim 25 wherein a new security code must be inputted within a predetermined period of time after activation of said programming state of operation.

35. The portable security alarm device defined in claim 25 including light means in electronic communication with said circuit means, said light means illuminating at a predetermined rate of illumination when said device is in its first state of operation.

36. The portable security alarm device defined in claim 25 including light means in electronic communication with said circuit means, said light means illuminating at a predetermined rate of illumination when said alarm means is activated.

37. The portable security alarm device defined in claim 25 including light means in electronic communication with said circuit means, said light means illuminating at a predetermined rate of illumination when said programming state of operation is selected.

38. The portable security alarm device defined in claim 25 wherein said trigger mechanism includes a pin member removably connected to said device, said pin member being pulled out of engagement with said device when the personal baggage is in at least a partially opened position.

39. The portable security alarm device defined in claim 25 wherein said attachment means includes means for attaching said security alarm device to the opening and closing means of the personal baggage and means for attaching said pin member to the personal baggage in the vicinity where the opening and closing means is in its closed position.

* * * * *

UNITED STATES PATENT AND TRADEMARK OFFICE

CERTIFICATE OF CORRECTION

PATENT NO. : 7,064,667 B2
APPLICATION NO. : 10/605594
DATED : June 20, 2006
INVENTOR(S) : Linda Sosna It is certified that error appears in the above-identified patent and that said Letters Patent is hereby corrected as shown below:

Item 57, Abstract, Line 9; delete “programming stat” and replace with - - programming state - -

Col. 3, line 42, delete “portions” and replace with - - portion - -

Col. 5, line 7 delete “the zipper” and replace with - - with zipper - -

Col. 6, line 49, delete “protions” and replace with - - portions - -

Col. 11, line 29, delete “person” and replace with - - personal - -

Signed and Sealed this

Fifteenth Day of August, 2006

JON W. DUDAS
*Director of the United States Patent and Trademark Office*